United States Patent [19]

Kurita et al.

[11] Patent Number: 4,496,630

[45] Date of Patent: Jan. 29, 1985

[54] POLYAMIDE FIBERS HAVING IMPROVED PROPERTIES AND THEIR PRODUCTION

[75] Inventors: Kazuo Kurita, Otsu; Hideaki Ishihara, Uji, both of Japan

[73] Assignee: Toyo Boseki Kabushiki Kaisha, Osaka, Japan

[21] Appl. No.: 464,089

[22] Filed: Feb. 4, 1983

[30] Foreign Application Priority Data

Feb. 6, 1982 [JP] Japan ..... 57/18021

[51] Int. Cl.[3] ..... D02G 3/00

[52] U.S. Cl. ..... 428/364; 264/210.7; 428/359; 428/373; 57/902

[58] Field of Search ..... 428/364, 373, 359; 264/210.7; 57/902

[56] References Cited

U.S. PATENT DOCUMENTS

| | | | |
|---|---|---|---|
| 2,807,863 | 10/1957 | Schenker | 264/210.7 X |
| 3,090,997 | 5/1963 | Au | 264/210.7 |
| 3,091,015 | 5/1963 | Zimmerman | 264/210.7 X |
| 4,009,511 | 9/1965 | Gauntt | 264/210.7 X |

FOREIGN PATENT DOCUMENTS

| | | | |
|---|---|---|---|
| 666693 | 7/1963 | Canada | 428/364 |

*Primary Examiner*—Lorraine T. Kendell

[57] ABSTRACT

A polyamide fiber excellent in strength, which is characterized by having a relative viscosity of not less than 2.3 (measured on a 96% by weight sulfuric acid solution having a polyamide concentration of 10 mg/ml at 20° C.), having an index of birefringence in section which satisfies the following relationship:

$$\Delta n_A - \Delta n_B < 0$$

(wherein $\Delta n_A$ is the index of birefringence of fiber at the position of $r/R=0.9$, $\Delta n_B$ is the index of birefringence of fiber at the position of $r/R=0.0$., R is the radius of the fiber section and r is the distance from the central axis of the fiber section), and showing the following physical constants:

Index of birefringence of fiber ($\Delta n$) (measured after 24 hours under the conditions of 30° C. and 80% relative humidity) $\geqq 50\times10^{-3}$;

Break strength $\geqq$ 11 g/d;

Fiber long period spacing value at length by small angle X-ray diffraction $\geqq$100 Å;

Specific gravity $\geqq$1.140;

Dry heat shrinkage $\leqq$15%.

12 Claims, 3 Drawing Figures

POLYAMIDE FIBERS HAVING IMPROVED PROPERTIES AND THEIR PRODUCTION

The present invention relates to polyamide fibers having improved properties, and their production. More particularly, it relates to polyamide fibers having high strength and being useful for reinforcement of rubber products, and their production.

In general, the distribution of the index of birefringence in section of a polyamide fiber prepared by conventional spinning and stretching procedures is smaller than that of a polyethylene terephthalate fiber and yet the outer layer of the polyamide fiber is higher than the inner layer in such index. Such polyamide fiber can be hardly stretched with a high stretch ratio. Its break strength is not sufficient and about 10 g/d at the most.

An extensive study has been made for overcoming the said drawbacks, and it has been found that the concentration of the stretching stress into the central portion of a filament, for instance, by effecting the stretching while heating locally the surface layer of the filament can make the deforming pattern on stretching remarkably mild and enhance the highest stretch ratio, compared with that in a conventional stretching procedure. In addition, the said concentration makes it possible to give a polyamide fiber having superior tensile strength and break strength in comparison with those of conventional high strength fibers.

The subsequent study starting from the above findings has succeeded in providing a polyamide fiber having a novel micro-structure and an extremely high strength.

The polyamide fiber of the present invention is characteristic in having a relative viscosity of not less than 2.3 (measured on a 96% by weight sulfuric acid solution having a polyamide concentration of 10 mg/ml at 20° C.), having an index of birefringence in section which satisfies the following relationship:

$$\Delta n_A - \Delta n_B < 0$$

(wherein $\Delta n_A$ is the index of birefringence of fiber at the position of $r/R=0.9$, $\Delta n_B$ is the index of birefringence of fiber at the position of $r/R=0.0$, R is the radius of the fiber section and r is the distance from the central axis of the fiber section, and showing the following physical constants:

Index of birefringence of fiber ($\Delta n$) (measured after 24 hours under the conditions of 30° C. and 80% relative humidity) $\geqq 50\times10^{-3}$;

Break strength $\geqq$ 11 g/d;

Fiber long period spacing value by small angle X-ray diffraction (hereinafter referred to as "fiber long period") $\geqq$ 100 Å;

Specific gravity $\geqq$ 1.140;

Dry heat shrinkage $\leqq$ 15%.

DETAILED DESCRIPTION

Figure 1:
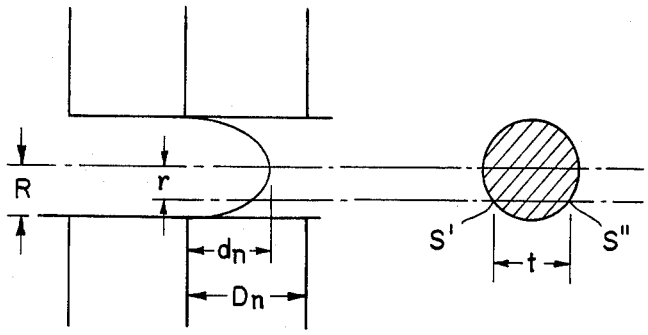
FIG. 1 illustrates variables $d_n$, $D_n$, S', S'' and t in the equation for light path difference set forth hereinafter.

The polyamide fiber of the invention is quite characteristic in having a higher index of birefringence in section at the inner layer than that at the outer layer, which is contrary to the distribution of the birefringence index in a conventional polyamide fiber. It is also characteristic that the fiber long period is not less than 100 Å, preferably not less than 110 Å, which is much longer than that of a conventional polyamide fiber of high strength. It is further characteristic that the index of birefringence and the specific gravity have the physical constants as given by the one as sufficiently stretched. It is notable that the break strength is not less than 11 g/d, preferably not less than 12 g/d, which is much improved in comparison with a conventional polyamide fiber of high strength, of which the break strength is nearly 10 g/d at the most. The polyamide fiber of the invention has a monofilament denier of less than 35 d.

From the above, it is understood that the microstructure of the polyamide fiber of the invention is entirely novel. The relative viscosity is not required to be extremely high and may be sufficient to have a value above 2.3, preferably above 3.0, although higher is better.

For manufacture of a polyamide fiber having a high strength, there are proposed a method wherein an unstretched polyamide filament is stretched in multi-steps (Japanese Patent Publn. No. 5113/60), a method wherein a polyamide having a high degree of polymerization is used for production of fibers (Japanese Patent Publns. Nos. 26572/70, 3936/73, 12085/73 and 2528/76), etc. However, the break strength of the polyamide fibers obtained by these methods are nearly 10 g/d at the most and is not satisfactorily high. This is probably due to the fact that they do not have such a specific micro structure as possessed by the polyamide fiber of the invention.

The said specific micro structure is remarkably produced when a polyamide mainly consisting of polycapramide and/or polyhexamethylene adipamide is used. Particularly, the use of a polyamide comprising polycapramide in an amount of 75% by weight on the basis of the weight of the polyamide. This is probably because polycapramide has a lower melting point in comparison with other polyamides and is easy in local heating at the surface layer of the filament for concentration of the stretching stress into the central part of the filament.

The use of a fiber having a monofilament denier of not more than 35 d is favorable. When the monofilament has a larger denier, the uniform centralization of stretching stress at the inner layer of a filament becomes difficult and prevents the stretching property.

The initial modulus of elasticity of conventional polyamide fibers is usually 40 g/d at the most, while that of the polyamide fiber of the invention is not less than 40 g/d, especially not less than 50 g/d. Also, the peak temperature of the heat stress with temperature elevation, which indicates that heat history on stretching, is not lower than 200° C., particularly not lower than 210° C., may be notable. When the peak temperature is lower than 200° C., the specific distribution of index of birefringence is hardly obtainable.

When a polyamide fiber of high strength is used as a reinforcing material for rubber products such as tire cord, the physical characteristics at high temperature are important. In case of evaluating the dependency of dynamic visco-elasticity on temperature as the measure for such physical characteristics under the conditions given a sine stress of 110 Hz, the temperature (Tα)

showing the maximum loss tangent (Tan δ) is 100° C. for conventional polycapramide fibers, while that is not lower than 110° C. for the polycapramide fiber according to the invention. The value Tα indicates the toughness of the polymer at the amorphous part, and higher Tα gives smaller depression of physical characteristics at a high temperature. Further, the polyamide fiber of the invention gives a maximum dynamic loss modulus of elasticity (E) of not less than $2.5\times10^9$ dyne/cm$^2$, which is much higher than $2.0\times10^9$ dyne/cm$^2$ as the maximum value for conventional polycapramide fibers of high strength. This characteristic property is quite effective for light weighing of tires.

In case of the polyamide fiber of the invention comprising polycapramide in an amount of not less than 75% by weight, the crystal size of the plane (200) is very large in micro structure, and characteristically it grows not less than 55 Å. This indicates that the oriented crystallization has proceeded well in the direction of main chain and plays an important roll for lengthening the fiber long period as well as enhancement of the break strength.

The polyamide fiber of the invention has the distribution of birefringence in section satisfying the following relationship:

$$\Delta n_A - \Delta n_B < 0 \quad (1)$$

preferably $$\Delta n_A - \Delta n_B \leqq -1.0\times1.0^{-3} \quad (2)$$

wherein $\Delta n_A$ and $\Delta n_B$ are each as defined above. In the above formulas (1) and (2), $\Delta n_A$ is a representative of Δn at the outer layer of the filament and $\Delta n_B$ is a representative of Δn at the inner layer of the filament. The polyamide fiber is characteristic in that Δn is smaller in the outer layer than in the inner layer.

Polyamides to be used for manufacture of the fibers of the invention may have a relative viscosity of not less than 2.3, preferably of not less than 3.0, when measured on a 96% sulfuric acid solution having a polymer concentration of 10 mg/ml at 20° C. Their specific examples include polycaprolactam, polyhexamethylene adipamide, polyhexamethylene sebacamide, etc. Copolymers of the monomeric components in said specific polyamides as well as condensation products of diamines such as 1,4-cyclohexane bis(methylamine) and linear aliphatic dicarboxylic acids are also usable.

For manufacture of the polyamide fiber of the invention, an unstretched fiber of polyamide may be prepared according to a conventional procedure. Any technical characteristics to be particularly explained is not present in any step up to the preparation of the unstretched polyamide fiber. Important is to stretch the unstretched polyamide fiber in two stages, of which the first stage stretching is carried out by a normal operation, for instance, application of steam and the second stage stretching is carried out in a heating zone wherein the temperature has a gradient from about 160°-220° C. at the entrance to about 220°-350° C. at the exit so that stretching proceeds in two steps. Formation of the said heating zone for the second stage stretching can be conveniently achieved by the use of at least one slit heater, e.g. one or two slit heaters.

For instance, a polyamide having a relative viscosity of 2.5 or more is melt spun, and the resulting unstretched filament of 0.002-0.035 in index of birefringence is stretched continuously or after once being taken up. On this stretching, the unstretched filament may be subjected to provisional stretching at a stretch ratio of not more than 1.10 between a first supply roller and a second supply roller maintained below 100° C. Then, the provisionally stretched filament is subjected to first stage stretching between the second supply roller and a first stretch roller for attaining not less than 40% of the total stretch ratio. Normally, a nozzle for jetting steam of high temperature and high pressure is provided between the second supply roller and the first stretch roller so as to apply steam jet (nozzle temperature, not less than 200° C.) to the travelling filament, whereby stretching is effected at the jetted part. The resulting filament runs onto a second stretch roller for second stage stretching. Between the first stretch roller and the second stretch roller, there is provided a slit heater kept at a temperature of 160° to 350° C. in inner temperature. Within the slit heater, the filament runs in a slit as the passage without any contact to the wall of the slit for a period of not less than 0.3 second. In the slit heater, the temperature is controlled so as to keep the temperature at the entrance around 160°-220° C. and the temperature at the exit around 220°-350° C., whereby the travelling filament is stretched in two steps. The thus stretched filament may be, continuously or after being once taken up, subjected to treatment for fixation at a temperature of 150° to 260° C. under a relaxed state of not more than 10%, whereby dimensional stability can be increased.

The fibers of the invention may be employed for various uses, particularly as reinforcing materials for rubber products. When employed as rubber reinforcing materials, they are normally used in a multi-filament state. However, this is not limitative, and the fibers may be used in any other state such as robing yarn, staple fiber or chopped strand. The fibers of the invention are suitably employed as tire cords, particularly carcass cords in radial structure tires for heavy weight vehicles and as rubber reinforcing cords in V belts, flat belts, toothed belts, etc.

The methods for measurement of various parameters as hereinabove and hereinafter referred to are explained below.

Measurement of relative viscosity (RV):

A polyamide was dissolved in conc. sulfuric acid (96.3±0.1% by weight) to make a concentration of 10 mg/ml. The falling time of 20 ml of the resulting solution ($T_1$; second) was measured at a temperature of 20±0.05° C. by the use of an Ostwald viscosimeter of 6 to 7 seconds in water falling time. Using the same viscosimeter as above, the falling time of conc. sulfuric acid as used above ($T_0$; second) was also measured. The relative viscosity (RV) was calculated according to the following equation:

$$RV = T_1/T_0$$

Measurement of index of birefringence (Δn):

Measurement was effected by the use of a Nikon polarization microscope (POH type) with a compensator manufactured by Reiz. As the light source, an apparatus for spectrum light source (Na) manufactured by Toshiba was used. A specimen cut at an angle of 45° to the fiber axis of 5 to 6 cm long was placed on a slide glass. The slide glass was placed on a rotatable stand, and the stand was rotated so as to make an angle of 45° between the specimen and the polarizer. An analyzer was inserted to make a dark field, the compensator was adjusted to 30, and the number of fringe patterns (n) was counted. The compensator was rotated clockwise and the scale (a) at which the specimen first became darkest was read. Then, the compensator was rotated counterclockwise, and the scale (b) at which the specimen first became darkest was read. The compensator was returned to 30, the analyzer was taken off, and the diameter of the specimen (d) was measured. The index of birefringence ($\Delta n$) was calculated according to the following equation (average of 20 measured values):

$$\Delta n = \Gamma / d (\Gamma = n\lambda_o + \epsilon)$$

$$\lambda_o = 589.3 \text{ m}\mu$$

wherein $\epsilon$ is obtained from C/10,000 and i in the Reiz's explanation sheet of the compensator, i being a-b (i.e. the difference in readings of the compensator).

Measurement of the distribution of $\Delta n$ in section:

From the refractive index at the center ($n\perp$, 0 and $n\parallel$, 0) and the refractive index at the outer layer ($n\perp$, 0.9 and $n\parallel$, 0.9) measured by the use of an interference-polarization microscope, the specific molecular orientation of the fiber of the invention is made clear, and the relationship between the fiber and its excellent strength can be shown. According to the interference band method using an interference-polarization microscope manufactured by Jena, the distribution of the average refractive index observed from the side of the fiber can be measured. This method is applicable to the fiber having a circular section. The refractive index of the fiber can be characterized by the refractive index ($n\parallel$) to the polarization vibrating in parallel to the fiber axis and the refractive index ($n\perp$) to the polarization vibrating vertically to the fiber axis. Measurements as hereinafter explained are all carried out with the refractive indexes ($n\parallel$ and $n\perp$) obtained by the use of a xenon lamp as the light source and a green color beam of an interference filter wavelength of 544 m$\mu$ under polarization.

Illustrating the measurement of $n\parallel$ as well as $n\parallel$, 0 and $n\parallel$, 0.9 obtainable from $n\parallel$, the fiber is immersed in a sealing agent having a refractive index ($n_E$) which will produce a gap of the interference band within a wavelength of 0.2 to 1 and being inert to the fiber by the use of a slide glass and a cover glass which are optically flat. The refractive index of the sealing agent ($n_E$) indicates the value measured by the use of an Abbe refractometer with a green color beam (wavelength, $\lambda = 544$ m$\mu$) at 20° C. The sealing agent may be, for instance, a mixture of liquid paraffin and $\alpha$-bromonaphthalene having a refractive index of 1.48 to 1.65. A monofilament of the fiber is immersed in the sealing agent, and the pattern of the interference band is photographed. The resulting photograph is expanded in 1,000 to 2,000 times and subjected to analysis.

As shown in FIG. 1 of the accompanying drawings, the light path difference (L) can be represented by the following equation:

$$L = \frac{d_n}{D_n} \lambda = (n\parallel - n_E)t$$

wherein $n_E$ is the refractive index of the sealing agent, $n\parallel$ is the average refractive index between S' and S'' of the fiber, t is the thickness between S' and S'', $\lambda$ is the wavelength of the used beam, $D_n$ is the distance of the paralleled interference bands of the background (corresponding to $1\lambda$) and $d_n$ is the gap of the interference band due to the fiber.

The pattern of interference bands as shown in FIG. 1 is evaluated using two kinds of the sealing agents having the following refractive indexes ($n_1$, $n_2$):

$$n_s < n_1$$

$$n_s > n_2$$

wherein $n_s$ is the refractive index of the specimen. Thus, the light path differences ($L_1$, $L_2$) in the case of using the sealing agents having the refractive indexes $n_1$, $n_2$ are representable by the following equations:

$$L_1 = \frac{d_1}{D_1} \lambda = (n\parallel - n_1)t$$

$$L_2 = \frac{d_2}{D_2} \lambda = (n\parallel - n_2)t$$

$$n\parallel = \frac{L_1 n_2 - L_2 n_1}{L_1 - L_2}$$

Accordingly, the distribution of the average refractive index ($n\parallel$) of the fiber in various positions from the center to outer layer of the fiber can be calculated from the light path difference at those positions according to the above equation. The thickness (t) may be calculated on the assumption that the fiber as obtained has a circular section. Due to any variation of the conditions on the manufacture or any accident after the manufacture, the fiber may have any non-circular section. In order to avoid the inconvenience caused by such section, measurement should be made for the parts where the gap of the interference band is symmetric to the fiber axis. Measurement is effected with intervals of 0.1 R between 0 and 0.9 R, R being the radius of the fiber, and the average refractive index at each position is obtained.

Likewise, the distribution of $n\perp$ is obtainable.

Therefore, the distribution of the index of birefringence may be calculated according to the following equation:

$$\Delta n(r/R) = n\parallel, r/R - n\perp, r/R$$

The value $\Delta n(r/R)$ indicates an average on at least three filaments, preferably 5 to 10 filaments.

Measurement of strength-elongation characteristics of fiber:

Using a tension tester manufactured by Toyo-Baldwin, the S—S curve of a monofilament was measured under the conditions of a specimen length (gauge length) of 100 mm, an elongation speed of 100%/min, a recording speed of 500 mm/min and an initial load of 1/30 g/d, and the break strength (g/d), the break elongation (%) and the Young's modulus (g/d) were calculated therefrom. The Young's modulus was calculated from the maximum inclination around the original point of the S—S curve. On calculation of each of the above characteristic values, the average one obtained from measurement for at least 5 filaments, preferably for 10 to 20 filaments, was used.

Measurement of fiber long period by small angle X-ray diffraction:

Measurement of the small angle X-ray scattering pattern was effected by the use of an X-ray generator (Model RU-3H) manufactured by Rigaku Denki. The conditions on measurement were as follows: tube voltage, 45 KV; tube current, 70 mA; copper target; CuK$\alpha$ monochromatized with a nickel filter ($\lambda x = 1.5418$ Å). A specimen was provided on a sample holder so as to keep the monofilaments in parallel. A suitable thickness of the specimen was 0.5 to 1.0 mm. X-rays were applied to the fibers vertically to the fiber axis arranged in parallel, and determination was made by the use of a position sensitive proportional counter (PSPC) system [cf. Polymer Journal, 13, 501 (1981)] manufactured by Rigaku Denki under the following conditions: 0.3 mm$\phi \times$0.2 mm$\phi$ pinhole collimeter; distance between specimen and probe, 400 mm; measured channel number with MCA (multi-channel analyzer), 256; measurement time, 600 seconds.

Figure 2A:
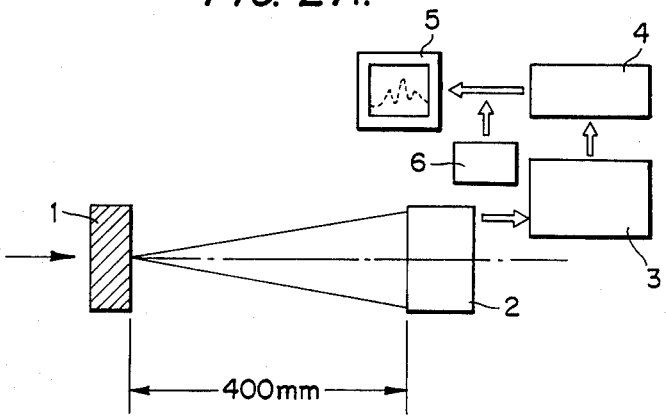
FIG. 2A illustrates apparatus for measuring scattering strength.
Figure 2B:
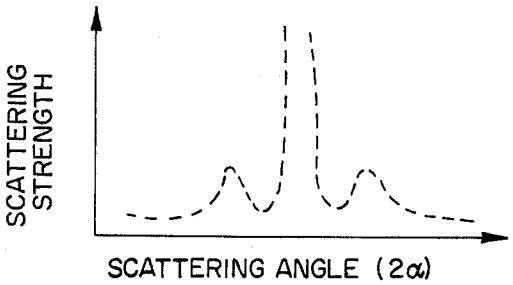
FIG. 2B is a graph of scattering strength vs. scattering angle.

Deduction of the air scatter strength from the measured scattering strength was obtained from the movement average treatment, and the long period small angle scattering angle ($2\alpha$) was read off from the strength maximum position. The fiber long period (d) was calculated according to the following equation (cf. FIGS. 2 (A) and (B) wherein 1 is a specimen, 2 is a PSPC probe, 3 is a position analyzer, 4 is MCA, 5 is an indication part and 6 is a micro-computer):

$$d = \frac{\lambda x}{2 \sin \alpha}$$

$$\lambda x = 1.5418 \text{ (Å)}$$

The movement average treatment was calculated according to the following equation:

$$I(S)_N = \sum_{i=N-K}^{i=N+K} I(S)_i / 2K + 1$$

wherein $I(S)_N$ and $I(S)_i$ are respectively the measured scattering strength at the channel number of N and that at the channel number i (the strength after deduction of the air scattering strength), K is the adopted point for movement average (i.e. K=7) and $N-K>0$, $N+K \leqq 256$.

Apparent crystal size (ACS):

The apparent crystal size was calculated from the half width at the diffractive strength of the plane (200) of the equatorial diffractive curve in the wide angle X-ray diffractive pattern according to the Scherrer's equation (cf. I. Nitta et al.: "X-sen Kesshogaku (X ray Crystallography)", Vol. 1, page 140):

$$ACS = \frac{0.9\,\lambda}{\sqrt{B^2 - \alpha^2}\,\cos\theta}$$

wherein $\lambda$ is an X-ray wavelength (1.5418 Å), B is a half width (rad), $\alpha$ is a corrected angle ($6.98 \times 10^{-3}$ rad) and $\theta$ is a diffractive angle (°).

The X-ray used in the Examples of the invention has a tube electric voltage of 45 KV, a tube current of 70 mA, a copper counter-negative electrode, a Ni filter and a wavelength of 1.5418 Å. As the diffractometer, a goniometer of SG-7 type manufactured by Rigaku Denki was used, and as the X-rays producing apparatus, a rotaunit of RU-3H type was used.

Dynamic temperature distribution:

Using Rheovibron manufactured by Toyo Keisokuki, measurement was made with an initial filament length of 4 cm, a temperature elevation speed of 2° C./min and a sine frequency on measurement of 110 Hz to determine the temperature (T$\alpha$) at which Tan $\delta = E'/E''$ gives the maximum, E' being the stock modulus (dyne/cm$^2$) and E'' being the lost modulus (dyne/cm$^2$) [cf. Memoirs of Faculty of Engineering Kyushu University, Vol. 23, page 41 (1963)]. The complex modulus of elasticity (E) can be calculated according to the equation:

$$|E| = 2.0 \times \frac{1}{A \cdot D} \times 10^9 \times \frac{L}{S}$$

wherein A is the coefficient due to the amplitude factor on measurement of Tan $\delta$ (cf. Table 1), D is the dynamic force dial value, L is the specimen length (cm) and S is the specimen section area (cm$^2$).

TABLE 1

| Amplitude factor | A |
|---|---|
| 0 db | 31.6 |
| 10 | 10 |
| 20 | 3.16 |
| 30 | 1 |
| 40 | 0.316 |
| 50 | 0.1 |
| 60 | 0.0316 |

The lost modulus of elasticity E'' is calculated according to the following equation $$E'' = |E| \sin \delta$$

Monofilament denier:

Measured according to JIS L1073 (1977)

Dry heat shrinkage:

Measured at 160° C. according to JIS L1073 (1977)

Specific gravity:

A density inclination tube comprising toluene and carbon tetrachloride was prepared, and a sufficiently defoamed specimen was admitted in the tube kept at a temperature of 30°+0.1° C. After allowed to stand for 5 hours, the position of the specimen in the tube was read off by the aid of the scale on the tube. The resulting value was calculated in terms of the specific gravity by the aid of a calibration curve between the scale of the inclination tube and the specific gravity. Measurement was made at n=4. The specific gravity was read off down to the fourth decimal place.

Heat stress peak temperature with constant length and temperature elevation:

Under the conditions of a specimen length of 4.5 cm, a temperature elevation speed of 20° C./min. and an initial load of 0.05 g/d, the heat shrinkage stress from room temperature to the melt cutting temperature was measured, and the temperature at which the heat stress was maximum was determined (cf. Textile Research Journal, Vol. 47, page 732 (1977)).

The present invention will be illustrated more in detail by Examples and Comparative Example wherein part(s) and % are by weight unless otherwise indicated.

EXAMPLES 1 AND 2 AND COMPARATIVE EXAMPLE 1

A polycapramide having a relative viscosity as shown in Table 2 was spun under the conditions as shown in Table 2 to make filaments, of which the index of birefringence ($\Delta n$) was as shown in Table 2.

On spinning, an appropriate amount of a spinning oil was applied onto the surfaces of the filaments before the taking up of them. The obtained filaments were subjected to stretching under the conditions as shown in Table 3 to give the stretched fibers having the properties as shown in Table 4 wherein the properties of a polycapramide fiber for commercially available tire cords are also given for Comparison.

TABLE 2

| | | Examples 1 & 2 |
|---|---|---|
| Relative viscosity of polycapramide | | 3.4 |
| Spinning condition | Spinning temperature (°C.) | 260 |
| | Diameter of nozzle hole (mmØ) | 0.3 |
| | Length of nozzle hole (mm) | 0.6 |
| | Injected amount per nozzle (g/min) | 1.75 |
| | Distance between nozzle surface and top of quenching zone (cm) | 24 |
| | Wind velocity for quenching (m/sec) | 0.3 |
| | Wind temperature for quenching (°C.) | 20 |
| | Length of quenching zone (cm) | 60 |
| | Take up speed (m/min) | 600 |
| Δn of unstretched filament | | 0.017 |
| Relative viscosity of unstretched filament | | 3.4 |
| Denier of unstretched monofilament | | 25.3 |

TABLE 3

| | | Example 1 | Example 2 |
|---|---|---|---|
| 1st Supply roller for unstretched filament | Temperature (°C.) | 20 | 20 |
| | Speed (m/min) | 50 | 30 |
| Preminary stretching | Time | 1.05 | 1.05 |
| 2nd Supply roller for unstretched filament | Temperature (°C.) | 20 | 20 |
| | Speed (m/min) | 52.5 | 31.5 |
| Pressurized steam | Temperature (°C.) | 250 | 250 |
| | Pressure (kg/cm$^2$) | 3.0 | 3.0 |
| 1st stretch roller | Temperature (°C.) | 20 | 20 |
| | Speed (m/min) | 141.2 | 86 |
| | Time | 2.69 | 2.73 |
| Slit heater No. 1 | Temperature (°C.) | 210 | 180 |
| | Length (mm) | 1000 | 1000 |
| Slit heater No. 2 | Temperature (°C.) | 230 | 250 |
| | Length (mm) | 300 | 500 |
| 2nd stretch roller | Temperature (°C.) | 20 | 20 |
| | Speed (m/min) | 222 | 168 |
| | Time | 1.57 | 1.95 |
| Total DR | | 4.4 | 5.6 |

TABLE 4

| | Example 1 | Example 2 | Comparative 1 |
|---|---|---|---|
| Monofilament denier (dpf: d) | 5.7 | 4.5 | 6.6 |
| Break strength (DT: g/d) | 11.5 | 13.5 | 9.9 |
| Elongation at break (DE: %) | 20.7 | 14.8 | 23.5 |
| Initial modulus of elasticity (IS: g/d) | 42.1 | 61.1 | 41.2 |
| Index of birefringence (Δn) | $58.8\times10^{-3}$ | $60.7\times10^{-3}$ | $57.0\times10^{-3}$ |
| Specific gravity (SG) | 1.146 | 1.144 | 1.135 |
| Dry heat shrinkage (SHD: %) | 7.5 | 8.3 | 11.0 |
| Fiber long period (LP: Å) | 108 | 124 | 90 |
| Apparent crystal size ($ACS_{200}$: Å) | 67.0 | 70.1 | 48.8 |
| $\Delta n_A-\Delta n_B$ | $-2.3\times10^{-3}$ | $-2.5\times10^{-3}$ | $2.5\times10^{-3}$ |
| $T_p$ (°C.) | 212 | 214 | 206 |
| Tα (°C.) | 107 | 123 | 100 |

TABLE 4-continued

| | Example 1 | Example 2 | Comparative 1 |
|---|---|---|---|
| $E''_{max}$ (dyne/cm$^2$) | $1.98\times10^9$ | $3.37\times10^9$ | $1.94\times10^9$ |

What is claimed is:

1. A stretched polyamide fiber excellent in strength, which is characterized by having a relative viscosity of not less than 2.3 (measured on a 96% by weight sulfuric acid solution having a polyamide concentration of 10 mg/ml at 20° C.), having an index of birefringence in section which satisfies the following relationship:

$$\Delta n_A-\Delta n_B<0$$

(wherein $\Delta n_A$ is the index of birefringence of fiber at the position of r/R=0.9, $\Delta n_B$ is the index of birefringence of fiber at the position of r/R=0.0, R is the radius of the fiber section and r is the distance from the central axis of the fiber section), and showing the following physical constants:

Index of birefringence of fiber (Δn) (measured after 24 hours under the conditions of 30° C. and 80% relative humidity) $\geqq 50\times10^{-3}$;

Break strength not less than 12 g/d;

Fiber long period spacing value at length by small angle X-ray diffraction ≧ 100 Å;

Specific gravity ≧ 1.140;

Dry heat shrinkage ≦ 15%; Monofilament denier of less than 35 d said polyamide being selected from the group consisting of polycapramide, polyhexamethylene adipamide, polyhexamethylene sebacamide, copolymers of the monomeric components of the aforestated polyamides, and condensation products of diamines and linear aliphatic dicarboxylic acids.

2. The polyamide fiber according to claim 1, which comprises polycapramide in an amount of not less than 75% by weight on the basis of the polyamide fiber.

3. The polyamide fiber according to claim 1, wherein the relative viscosity of the polyamide is not less than 3.0.

4. The polyamide fiber according to claim 1, of which the initial modulus of elasticity is not less than 40 g/d.

5. The polyamide fiber according to claim 1, of which the heat stress peak temperature with temperature elevation of constant length is not lower than 200° C.

6. The polyamide fiber according to claim 2, of which the temperature (Tα) giving a maximum dynamic loss tangent (Tanδ) determined at 110 Hz is not lower than 110° C.

7. The polyamide fiber according to claim 2, of which the apparent crystal size (ACS) at the plane (200) obtainable by a broad angle X-ray diffraction is not less than 55 Å.

8. The polyamide fiber according to claim 1, of which the initial modulus of elasticity is not less than 50 g/d.

9. The polyamide fiber according to claim 1, of which the peak temperature of heat stress on temperature elevation with constant length is not lower than 210° C.

10. The polyamide fiber according to claim 2, of which the maximum value of the dynamic loss modulus of elasticity is not less than $2.5\times10^9$ dyne/cm$^2$.

11. The polyamide fiber according to claim 1, of which the index of birefringence (Δn) is not less than $55\times10^{-3}$ and $(\Delta n_A-\Delta n_B)$ is not more than $-1.0\times10^{-3}$.

12. The polyamide fiber according to claim 1, of which the fiber long period is not less than 110 Å.

* * * * *